US006144622A

United States Patent [19]

Berney

[11] Patent Number: 6,144,622

[45] Date of Patent: Nov. 7, 2000

[54] WATCH COMPRISING SENSING AND SAVING MEANS IN CASE OF INSUFFICIENCY OF SUPPLY SOURCE

[75] Inventor: Jean-Claude Berney, Les Charbonnieres, Switzerland

[73] Assignee: Eta SA Fabriques d'Ebauches, Grenchen, Switzerland

[21] Appl. No.: 09/341,842

[22] PCT Filed: Jan. 21, 1998

[86] PCT No.: PCT/CH98/00020

§ 371 Date: Jul. 19, 1999

§ 102(e) Date: Jul. 19, 1999

[87] PCT Pub. No.: WO98/33098

PCT Pub. Date: Jul. 30, 1998

[30] Foreign Application Priority Data

Jan. 23, 1997 [CH] Switzerland ..... 0143/97

[51] Int. Cl.[7] ..... G04B 1/00; G04C 3/00

[52] U.S. Cl. ..... 368/204

[58] Field of Search ..... 368/64, 66, 80, 368/203–204

[56] References Cited

U.S. PATENT DOCUMENTS

| | | | |
|---|---|---|---|
| 4,041,691 | 8/1977 | Chihara et al. | 58/23 BA |
| 4,280,208 | 7/1981 | Nomura | 368/66 |
| 4,314,274 | 2/1982 | Ushikoshi | 368/66 |

FOREIGN PATENT DOCUMENTS

| | | |
|---|---|---|
| 0 285 838 | 10/1988 | European Pat. Off. . |
| 0 591 557 | 4/1994 | European Pat. Off. . |
| 31 15 682 | 11/1982 | Germany . |

*Primary Examiner*—Vit Miska
*Attorney, Agent, or Firm*—Griffin & Szipl, P.C.

[57] ABSTRACT

An electronic watch in which the position of the hands is managed by the electronic circuit for displaying data internal to the circuit, in particular time data. Said watch comprises means for detecting supply insufficiency combined for bringing and maintaining the hands on reference positions when such deficiency is detected, thus avoiding a discrepancy between the indications of the hands and the internal data which they must display when the supply source is back to normal.

12 Claims, 4 Drawing Sheets

7
9
16
17
18
S
27
26
20
26
28
+
-
29
25
23
21
C
6
5
R
22
+
-
24
réf

Volts 1.60
nominal voltage
1.35
zone 1: normal operation, counter + motor OK
1.15
zone 2: counter OK, display on demand
zone 3: counter OK, display blocked on 0
0.80
zone 4: counter uncertain, display blocked on 0
zone 5: hold of logic circuit state not assured 43
42
17
R
S
40
R
18
7
41

WATCH COMPRISING SENSING AND SAVING MEANS IN CASE OF INSUFFICIENCY OF SUPPLY SOURCE

In a large number of current electronic watches, there are means for detecting insufficiency of the supply source called EOL for <<end of life>> which indicate that the battery reaches the end of its life. Such detection, essentially based on the measurement of a minimum battery voltage, generally generates particular behaviour of the second hand of the watch, which is capable of drawing the user's attention to the fact that he needs to change the battery as soon as possible. There also exist watches including two hands driven by at least one motor wherein the position of the hands is controlled by the electronic circuit so as to display internal circuit data, for example time data. This is the case of the TWO TIMER watch by Tissot, wherein the positions of the hour and minute hands have to correspond to an internal electronic counter also able to be digitally displayed. The same is true for the displays of the chronograph of the watch Swatch Chrono as well as for the watches Stop Swatch and Swatch MusiCall wherein the hands can display either the hours and the minutes, or an alarm time, or an internal counter. This type of arrangement requires perfect synchronisation between the internal electronic counters and the movement of the hands on the dial. However, in the aforecited watches, this synchronisation can no longer be assured when the power supply has been interrupted. Thus it is necessary, for example when the battery is changed, to perform a quite complicated hand phase setting operation which is not easy for the average user.

This is not serious insofar as the battery is generally only changed after several years, and when said user goes to an approved seller to change the battery, said seller himself undertaking the operation. It would be much more inconvenient within the scope of watches which are automatically recharged by solar cells or a generator. As a matter of fact, this type of watch has a much more limited power reserve and it would be very restrictive for the user to have to perform this hand phase setting operation each time that he put his watch to one side for a few days.

The object of the present invention is precisely to provide a simple and efficient solution to this problem. The invention concerns an electronic watch including at least two hands driven by at least one motor, electronic means arranged for positioning said hands on the dial so as display internal data determined by said electronic means, in particular time data, as well as a power source and means for detecting any insufficiency of said power source, This is not serious insofar as the battery is generally only changed after several years, and said user goes to an approved seller to change the battery, said seller himself undertaking the operation. It would be more inconvenient within the scope of watches which are automatically recharged by solar cells or a generator. This type of watch has a much more limited power reserve and it would be very restrictive for the user to have to perform this hand phase setting operation each time that he put his watch to one side for a few days.

European Patent No. A-591557 concerns an electronic watch including at least two hands driven by at least one motor, electronic means arranged for positioning said hands on the dial to display internal data determined by said electronic means, in particular time data, as well as a power source. Detection means supply signals in the event of an insufficiency of the power source. During this detection, the position of the hands and the value of the corresponding electronic counters are stored in a non-volatile memory provided for this purpose.

European Patent No. A-285838 concerns an electronic watch including at least two hands driven by at least one motor, electronic means arranged for positioning said hands on the dial to display internal data determined by said electronic means, in particular time data, as well as a power source. According to this document, detection means supply signals corresponding to an insufficiency of the power source.

The additional functions are then stopped and the minute hand can be brought back to the zero position to indicate to the user the End of Life (EOL) situation. Conversely, the hour hand continues to display the present time. When there is sufficient power again, the radio receiver is switched on and the usual initialisation procedure for Junghahs watches is performed (hands set at zero, wait to receive a valid time telegram, then automatic time setting).

The object of the present invention is to provide a simple, efficient and easily implemented solution to this problem. The invention concerns an electronic watch including at least two hands driven by at least one motor, electronic means arranged for positioning said hands on the dial so as display internal data determined by said electronic means, in particular time data, as well as a power source and means for detecting any insufficiency of said power source, characterised in that said electronic means are arranged so as to bring and keep the set of hands on reference positions when said detection means supply signals corresponding to an insufficiency of the power source.

Figure 1:
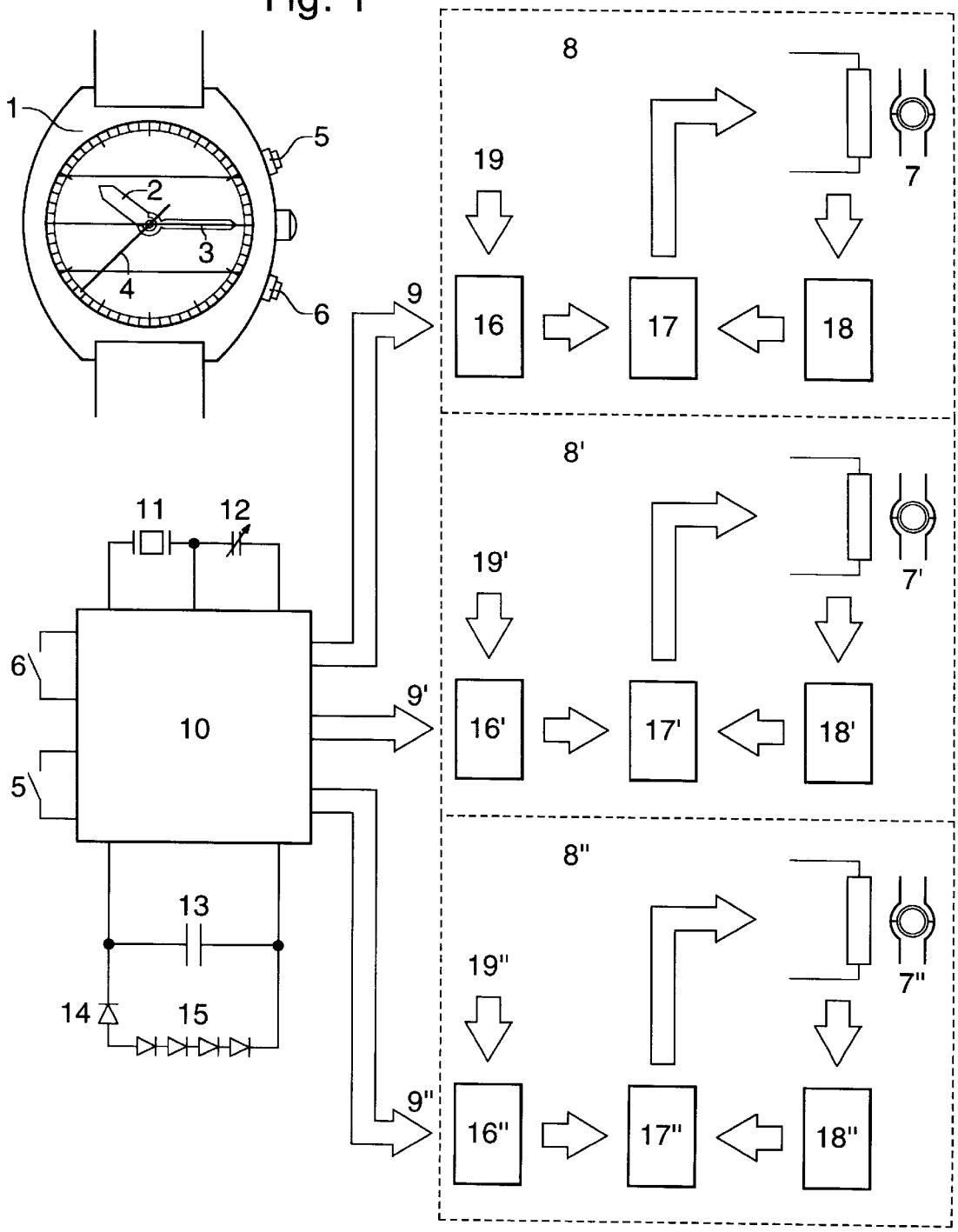
FIG. 1 shows schematically and by way of example the circuit of a watch according the invention.

FIG. 1 shows schematically and by way of example the circuit of a watch according to the invention. This Figure shows a watch 1 including three hands 2, 3 and 4, mounted on concentric shafts. This watch includes control means in the form inter alia of two push buttons 5 and 6. In this description, it is admitted that the different hands 2, 3 and 4 are driven independently of each other by their own motor 7, 7' and 7", but the invention also applies to watches wherein several hands are driven by the same motor as in the TWO TIMER. In the configuration of FIG. 1, each motor is controlled by a combination of electronic circuits, 8, 8' and 8", arranged for positioning the corresponding hands on the dial so as to display internal data, 9, 9' and 9", supplied by the watch counting and control circuit 10. At the present time, the set of functions of the electronic means shown in FIG. 1 can be realized in sequential logic programmed by a microprocessor. They have been shown schematically in the form of a combination of circuits in order to facilitate comprehension of the invention.

Counting and control circuit 10 is connected to push buttons 5 and 6, and includes a time base regulated by the quartz resonator 11 adjusted by the capacitive trimmer 12. The watch assembly is supplied by a power source which could be a battery, or a Gold Cap or an accumulator charged by a generator or a solar cell battery. FIG. 1 shows this latter solution via Gold Cap 13, charged through diode 14 by a group of photovoltaic cells 15, generally arranged on the dial of the watch. The counting and control circuit supplies data 9 to circuit combination 8 to position hand 2. This circuit combination 8 includes a selection circuit 16 whose output is connected to a comparator 17 also connected to the output of a logic circuit 18 the state of which is representative of the position of hand 2 on the dial. Comparator 17 is connected to the control circuit for motor 7, which is itself connected to the input of logic circuit 18. This forms a control loop which tends to keep the outputs of circuits 16 and 18 equal. In the event of inequality, comparator 17 acts on the control circuit for motor 7 and on logic circuit 18 to cause them to advance step-by-step until equality is re-established between the outputs of circuits 16 and 18. Thus hand 2 displays internal data determined by the electronic means as they are supplied at the output of selection circuit 16. Likewise, hand 3 displays data supplied at the output of selection circuit 16' via comparator 17' and of logic circuit 18', while hand 4 displays data supplied at the output of logic circuit 16" via comparison circuit 17" and logic circuit 18". Such systems have already been described and operate in the watches which were cited hereinbefore. In order for the system to operate properly, as already mentioned, the state of logic circuit 18 must be, representative of the position of the corresponding hand on the dial. Thus if this hand makes 60 steps per revolution, logic circuit 18 must have 60 states corresponding to the 60 possible positions of the hand on the dial, and its 0 state must correspond for example to the position of the hand at 12 o'clock (midday). In this example, 12 o'clock corresponds to the reference position of the hand corresponding to the 0 state of logic circuit 18. This is the reference which will be used in the description but any position of the hand corresponding to any state of logic circuit 18 can theoretically be used as a reference.

When the circuit is supplied normally motor 7 and logic circuit 18 operate in concert, and the synchronisation between the display and the state of circuit 18 can be maintained without any problem. This is not so when the supply voltage goes below a critical threshold, or disappears. After a change of battery, logic circuit 18 is put either in any state or in the 0 state if a POR (power on reset) is performed. There is often a displacement and counter 18 is no longer representative of the position of the hand on the dial. The same is true for circuits 18' and 18". In order to correct this, a phase resetting operation has to be performed, which consists in first bringing the different hands to 12 o'clock, then resetting the corresponding logic circuits to 0. This procedure is relatively complex and many users do not know how to use it. It will not be described in more detail since this type of procedure is known in the watches which have been cited. This restriction has little importance in the event of a change of battery, since the person who performs this operation is supposed to be competent to perform the phase resetting operation. It is much more critical in the case described in FIG. 1, where the power supply is assured by a Gold Cap recharged by solar cells. It is known that the power reserve of such watches is presently only a few days, and it is unthinkable for the user to have to go to an approved agent each time that he has put his watch to one side a little too long and it stops. A way of avoiding this phase resetting of logic circuits 18 and the corresponding hands each time would be a setting to 0 when the power supply becomes insufficient, but is still high enough to assure operation of the motors. This setting to 0 consists in bringing the hands and the logic circuits to their reference position, and locking the hands and logic circuits in this position, until the power supply becomes normal again. This is precisely the object of the present invention. This setting to 0 can be very simply performed by blocking the output of selection circuit 16 at 0. In order to do this, circuit 16 includes an input 19 which switches the output to 0 whatever the state of input 9, which brings hand 2 to 12 o'clock and logic circuit 18 to 0. Of course input 19 could switch the output of selection circuit 16 to any chosen reference value other than 0. Selection circuits 16' and 16" include inputs 19' and 19" allowing hands 3 and 4 to be set to 12 o'clock. Thus hands, 2, 3 and 4 can be set to 12 o'clock either together or separately.

Figure 2:
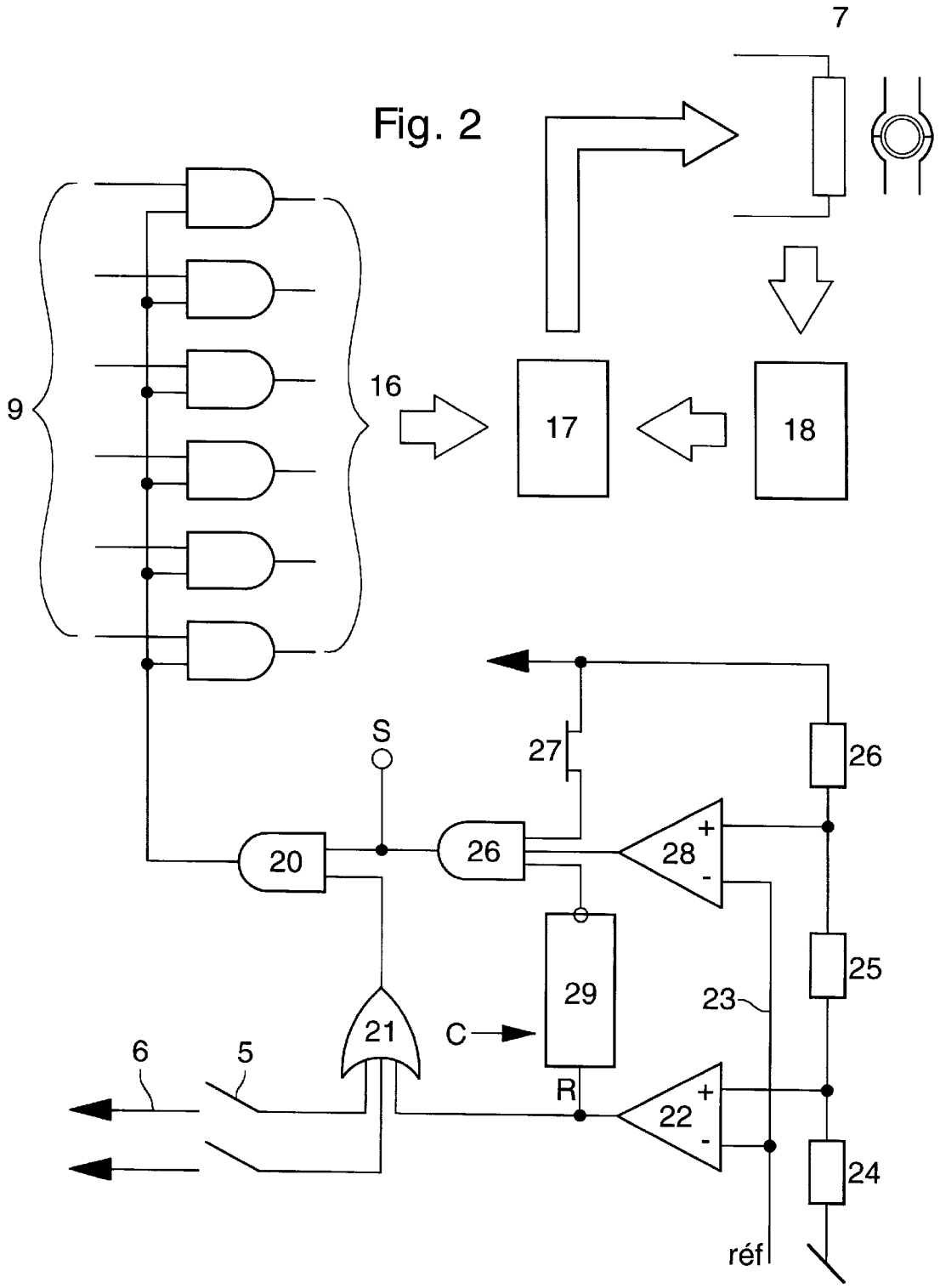
FIG. 2 shows schematically and by way of example means for detecting insufficiency in the power source and the electronic means associated therewith.

FIG. 2 shows schematically and by way of example means for detecting any insufficiency in the power supply and the electronic means which are associated therewith. One sees again in this Figure comparator 17 and logic circuit 18 which act on motor 7 so as to control the position of the corresponding hand on the dial. Selection circuit 16 is formed of 6 AND gates receiving at their first inputs the internal data to be displayed. The second inputs of these 6 AND gates are connected to the output of an AND gate 20. When this output is at 1, the 6 AND gates are conducting and internal data 9 are transmitted to their outputs and thereby to the input of comparator 17 so as to be displayed. On the contrary, when the output of AND gate 20 is at 0, the outputs of AND gates 16 are at 0. The hand driven by motor 7 moves until the state of logic circuit 18 is also equal to 0, which corresponds to the positioning of the hand at 12 o'clock. This condition is maintained as long as the output of AND gate 20 is at 0. If this output again passes to 1, internal data 9 will again be transmitted by the output of AND gates 16 to the input of comparator 17 and the hand driven by motor 7 returns to the position on the dial corresponding to the display of such data.

The output of AND gate 20 passes to 0 when one or the other of its inputs passes to 0. Let us examine the conditions in which this occurs. The first input of this gate 20 is connected to the output of an OR gate 21 whose first input is connected to a voltage comparator 22 connected on the one hand to an internal voltage reference 23 and on the other hand to a network of resistors 24, 25 and 16 connected to the terminals of the power supply. When the voltage of the power supply is correct the output of voltage comparator 22 is at 1. When this voltage goes below a first level, the output of voltage comparator 22 passes to 0. The two other inputs of OR gate 21 are connected to the contacts of push buttons 5 and 6. These inputs are normally at 0 when these contacts are open and momentarily pass to 1 when the user presses them.

Let us assume that the second input of AND gate 20 is at 1 and contacts 5 and 6 are open. When the power supply has a sufficient voltage, the output of voltage comparator 22 is at 1 as is the output of OR gate 21 and the output of AND gate 20. The hand driven by motor 7 displays data 9. When the voltage of the power supply passes below a first level, the output of voltage comparator 22 passes to 0, as do the outputs of gates 21, 20 and 16, and the hand driven by motor 7 is positioned at 12 o'clock and stays there. However, the user has only to press on one of pushers 5 or 6 for the output of gates 21 and 22 to pass to 1 again and for the correct display of data 9 to be re-established. This is an intermediate situation in which the hands are brought to 0, which allows the user's attention to be drawn to the fact that the power supply is becoming insufficient, while allowing him momentarily to re-establish the correct display of his watch by pressing on one of the push buttons. In the particular case in which one of the hands, for example hand 4, is used for indicating the seconds, one could simply give a particular movement to this second hand in this intermediate situation, or bring only this second hand to 0. In the case described it will however be assumed that the three hands are reset to 0.

Let us now consider what happens at the second input of AND gate 20 connected to terminal S and at the output of the three input AND gate 26. The first input is connected to a safety contact 27 whose utility will be explained with reference to FIG. 5. When this contact is open, the output of AND gates 26, 20 and 16 pass to 0. The display is set to 0 and the hands are positioned at 12 o'clock. The two other inputs of AND gate 26 define conditions which can either be cumulated as is the case here, or used in isolation. The second input of AND gate 26 is connected to the output of a voltage comparator 28 one input of which is connected to voltage reference 23, and the other is connected to the network of resistors 24, 25 and 26. When the power supply voltage is sufficient, the output of voltage comparator 28 is at 1. When this voltage passes below a second level, this output passes to 0, as do the outputs of AND gates 26, 20 and 16. The display is set at 0 and the hands are positioned at 12 o'clock. Finally the third input of gate 26 is connected to the inverting output of a delay line 29 formed for example by a shift register which receives pulses every 12 hours at its clock input from the counting circuit. This register 29 is maintained at 0 as long as the output of voltage comparator 22 is at 1 and becomes active when it passes to 0, i.e. when the power supply voltage passes below the first detection level. When the delay fixed by the shift register is reached, its inverting output passes to 0, as do the outputs of AND gates 26, 20 and 16. The display is set at 0 and the hands are positioned at 12 o'clock. It is to be noted that the conditions which determine the passage to 0 of the output of AND gate 26, which causes the display to be set to 0 and the hand to be kept at 12 o'clock, cannot in any event be cancelled by pressing push buttons 5 or 6, as is the case found in the intermediate situation. If his watch is supplied by a battery, the user is obliged to change it. In this case the behaviour of his watch during the intermediate situation should have attracted his attention and allowed him to change his battery before his watch became completely blocked. If his watch includes a system for solar cell or generator recharging, he must either expose it to light, or impart sufficient movements of rotation thereto. In these two latter cases, the passage through the intermediate situation is not indispensable seeing that the user can re-establish a normal situation himself without going to an agent. It is to be noted that the electronic circuit of the watch continues to operate at a much lower voltage than the motors. Thus the correct display of the watch can be found again, even if it has been completely blocked, which will be discussed with reference to FIG. 3.

Figure 3:
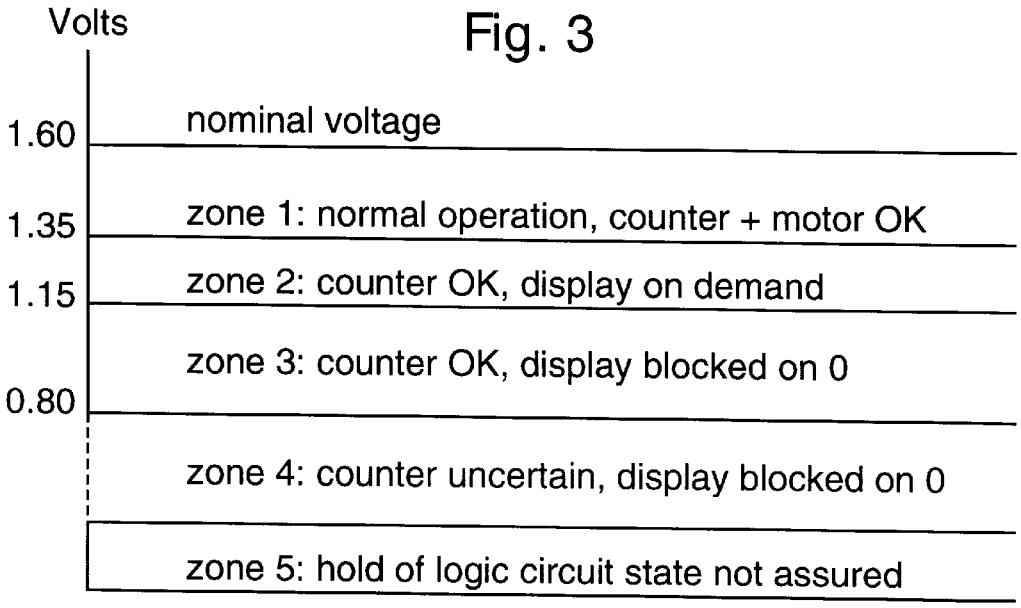
FIG. 3 shows schematically and by way of example the different operating zones of the means of FIG. 2.

FIG. 3 shows schematically and by way of example the different operating zones of the means of FIG. 2. Let us assume that the watch is supplied by photovoltaic cells with a nominal voltage of 1.6 volts, and that there is a first detection level at 1.15 volts. Moreover, the circuit consumption is 0.2 $\mu$A and that of the motors is 0.6 $\mu$Coulomb per step. These motors operate correctly to 1 volt. For a watch which beats the seconds, the total consumption is 0.8 $\mu$A. In a conventional watch, this consumption is constant and remains even when an insufficiency is noted in the power supply and the EOL (end of life) system is operating. Thus the Gold Cap which assures the power reserve will continue to be discharged at the same rhythm and the watch will stop after a few hours.

In our case, it can be seen that there is a first zone 1 where the normal operation of the watch is assured. Then, between detection levels 1 and 2, there is a zone 2 where at least the second hand, or the set of hands, is blocked at 12 o'clock. Although the user can re-establish the normal display on demand, the average consumption of the motors becomes very low, and the consumption of the whole of the watch is brought to 0.25 $\mu$A, i.e. a reduction of more than three times. This means not only that the discharge of the Gold Cap will be slowed down by the same factor, but that three times less illumination of the photovoltaic cells is enough to stabilize the voltage and maintain the watch in this state. When the voltage passes below the second detection level, one passes to zone 3 and all the hands are blocked at 12 o'clock. All that remains is the circuit consumption of 0.2 $\mu$A. In this zone, the operation of the motors could no longer be assured and a conventional watch would lose time definitively. In our case, the hands are blocked in known positions and the consumption is reduced to the maximum, but the electronic circuit continues to assure its different functions, particularly its time functions. It is known that present CMOS low voltage circuits can currently operate at up to 0.8 volts. NEC has even announced circuits operating at 0.4 volts. Thus, if the power supply voltage increases from zone 3 to the higher zones, the correct display of the functions by the hands is automatically re-established. In zone 3, as in zone 2, very low illumination of the photovoltaic cells is required to stabilise the voltage and maintain proper operation of the circuit functions. If however, the voltage continues to decrease, one enters zone 4 where the circuit can no longer assure these functions. When the voltage increases to its normal level, the time of the watch will therefore have to be reset. Conversely, in this zone 4, the logic states of circuits 18 representative of the position of the hands on the dial can be preserved, and it will not be necessary to perform the phase setting procedure when the voltage is restored to normal. If however the voltage continues to decrease and one passes into zone 5, one can no longer guarantee that the logic states of circuits 18 will be kept. Of course all the hands are at 12 o'clock, but circuits 18 are highly likely not to be in the corresponding state when the voltage increases again. It is thus necessary to introduce a POR (power on reset) procedure, i.e. a procedure for setting these logic circuits 18 to 0 when the voltage increases, which must take into account that the voltage may increase very slowly. This is what will be seen in the following Figure.

Figure 4:
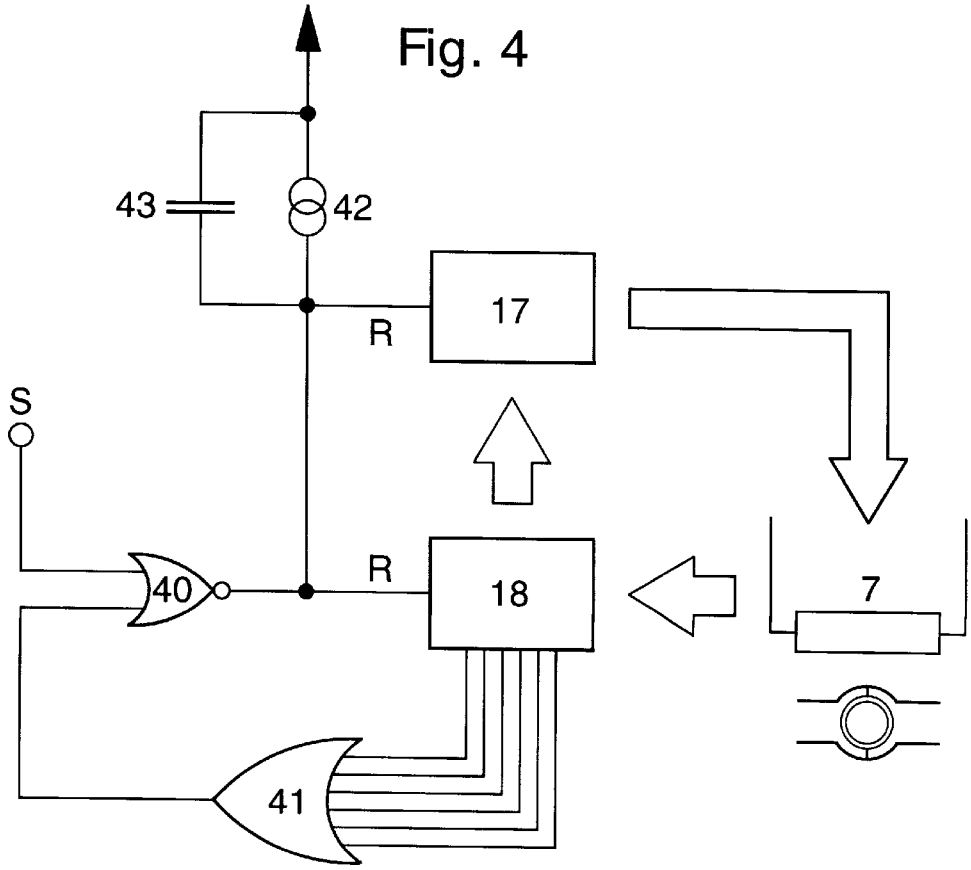
FIG. 4 shows schematically and by way of example a circuit allowing the means of FIG. 2 to be placed in proper starting conditions when the power source re-established.

FIG. 4 shows schematically and by way of example a circuit allowing the means of FIG. 2 to be placed in the correct starting conditions when the power supply is re-established. One sees again in this Figure motor 7, logic circuit 18 whose state is representative of the position on the dial of the hand driven by the motor, and comparison circuit 17. Terminal S corresponding to the output of AND gate 26 of FIG. 2 is connected to a first input of a NOR gate 40 whose output is connected to the reset inputs of circuits 17 and 18. When the power supply voltage is correct, terminal S is at 1 and the output of gate 40 is at 0. When one passes into zone 2 of FIG. 3, terminal S passes to 0. The logic outputs representing the state of circuit 18 are connected to an OR gate 41 whose output is connected to the second input of NOR gate 40. If the state of circuit 18 is different to 0, the output of OR gate 41 is at 1 and the output of NOR gate 40 remains at 0. The fact that circuit 18 is not at 0 means that the hand has not yet reached the 12 o'clock position at which it should become blocked. As soon as it reaches this position, the state of circuit 18 passes to 0. The output of OR gate 41 passes to 0 and the output of NOR gate 40 to 1. Circuits 17 and 18 are then blocked at 0 as is the entire control loop which determines the sending of pulses to the motor. One must pass back into zone 2 for terminal S to pass to 1 again and for this blockage to disappear. Now, what will happen if the power supply voltage goes down to zone 5, or even passes to 0 during a certain period of time. In that case, circuits 17 and 18 must be reset to 0 when the voltage is restored, so as to prevent these circuits being placed in an undetermined state. In order to do this, the output of gate 40 is connected by a current source of very low intensity 42 and a capacitance 43 to the positive supply pole. These two elements allow the reset inputs of circuits 17 and 18 to be forced to 1 when the voltage is restored and to set them to 0 before normal operation of the electronic circuits is re-established. Thus logic circuit 18 is set in the 0 state corresponding to the 12 o'clock position of the hand and it is not necessary to perform the phase setting procedure.

Figure 5:
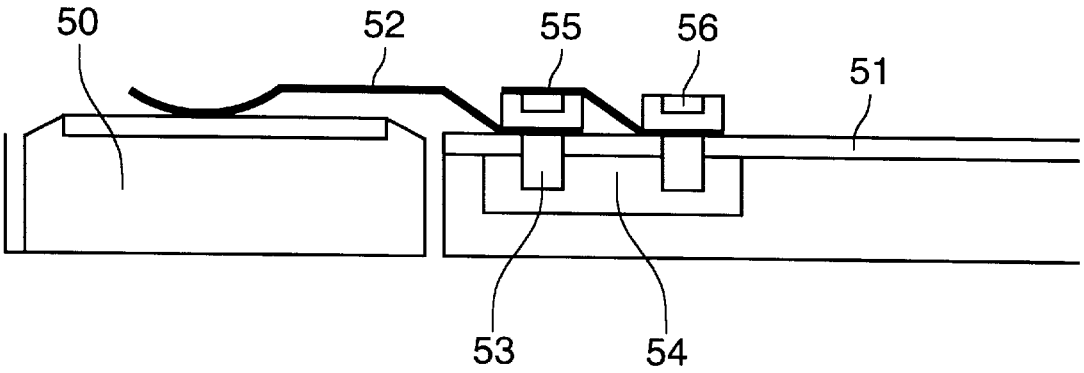
FIG. 5 shows schematically and by way of example a safety device allowing the position of the hands to be locked when the battery is changed.

FIG. 5 shows schematically and by way of example a safety device allowing the position of the hands to be blocked when the battery is changed. It has been shown that it is possible to keep logic circuits 18 in phase with the hands by bringing them to 12 o'clock and blocking them there. But what happens if the battery is disconnected while the voltage is still sufficient. The hands will not have time to move to the correct position and synchronisation will be lost. In order to prevent this, one can use a safety contact such as contact 27 of FIG. 2, which must compulsorily be opened before the battery can be disconnected. Thus one indicates to the circuit that the power supply may disappear rapidly, and the circuit is left sufficient time to bring the hands into the 12 o'clock position. FIG. 5 shows battery 50 connected to printed circuit 51 by a contact spring 52 fixed by means of a screw 53 which is screwed into an insulated case 54. Screw 53 is covered by a second contact spring 55 fixed by screw 56. Contact spring 55 is arranged so as to establish an electric connection between the+pole of the battery and a contact zone of printed circuit 51 situated under the head of screw 56, via contact spring 52 and the head of screw 53. It can easily be seen that if one wishes to disconnect the battery, screw 56 must first be unscrewed and spring 55 removed. Doing this interrupts the connection between the contact zone of the circuit and the+supply pole. This combination acts as safety contact as described in FIG. 2. When the battery is put in place, the hands remain blocked at 12 o'clock until contact spring 55 has been put in place. When the battery is removed, contact 55 must first be removed, which allows the hands time to move into the 12 o'clock position, before the battery can be disconnected.

Numerous other combinations implementing the present invention exist, but the description thereof would add nothing to comprehension of the invention.

What is claimed is:

1. An electronic watch including at least two hands driven by at least one motor, electronic means arranged for positioning said hands on the dial so as to display internal data determined by said electronic means, in particular time data, as well as a power source and means for detecting any insufficiency of said power source, characterized in that said electronic means are arranged for bringing and keeping the set of hands on reference positions when said detection means supply signals corresponding to an insufficiency of the power source when the voltage of the power source becomes insufficient to permanently assure a correct display of said internal data by the hands but is still high enough to assure a normal operation of said electronic means and enable the latter to re-establish automatically said correct display of said internal data by the hands when the voltage of the power source becomes again sufficient to assure such a display.

2. A watch according to claim 1, characterized in that said reference positions correspond to the 12 o'clock position of the hour scale.

3. A watch according to claim 1, characterized in that said detection means are arranged for determining an intermediate situation preceding detection of the insufficiency of the power source, the electronic means being arranged for determining a particular behavior of the hands in response to detection of this intermediate situation.

4. A watch according to claim 3, characterized in that said electronic means are arranged for bringing the set of hands onto reference positions when said detection means supply signals corresponding to said intermediate situation, and for re-establishing momentarily and upon request the correct display of the internal data.

5. A watch according to claim 3, characterized in that said detection means include first and second power source voltage level detectors for detecting first and second voltage levels of said power source; said first detector supplying power source insufficiency signals to the electronic means when the power source voltage becomes lower than the first level, and said second detector supplying signals corresponding to the intermediate situation when said voltage is between said two voltage levels.

6. A watch according to claim 3, characterized in that said detection means include at least one power source voltage level detector associated with a time counter, said detection means being arranged so as to trigger said time counter when the power source voltage becomes lower than said voltage level, and to supply first signals corresponding to said intermediate situation, then power source insufficiency signals when said time counter reaches a state corresponding to a predetermined period of time.

7. A watch according to claim 1, characterized in that said electronic means are arranged for bringing and keeping the set of hands on reference positions in response to the change of state of a safety contact.

8. A watch as claimed in claim 1 wherein, said power source is a rechargeable power source.

9. A watch comprising: an electronic time-keeping circuit producing time data output signals; a dial; at least two hands movable over said dial to display time represented by said time data output signals; a power source and a voltage level detection circuit for detecting the voltage of said power source; a control circuit for controlling said at least one motor to move said hands over said dial; a comparator means in said control circuit for comparing said time data output signals to signals representing time displayed by said hands, said comparator means producing output signals to drive said at least one motor so that said hands are moved according to said time data output signals; and a gating circuit connected between said time-keeping circuit and said comparator means, said gating circuit being responsive to said voltage level detection circuit for blocking said time data output signals so that said hands are moved to reference positions when said detection circuit detects a voltage level that is insufficient to permanently assure a correct display of time by said hands but is still high enough to assure a normal operation of said time-keeping circuit, and said control circuit, said voltage level detection circuit enabling said gating circuit so that said time data output signals are again applied to said comparator means to automatically re-establish said correct display of said time by said hands when the voltage of the power source again becomes sufficient to assure a correct display.

10. A watch as claimed in claim 9 wherein, when said time output signals are blocked, said comparator produces output signals to drive said at least one motor to move said hands to a 12 o'clock position.

11. A watch as claimed in claim 9 wherein, said voltage level detection circuit includes intermediate level detection means for detecting an intermediate voltage level of said power source, said intermediate voltage level being less than a nominal operating voltage level of said power source but greater than said voltage level insufficient to permanently assure a correct display of time by said hands, said intermediate level detection means producing an output signal to block said gating means upon detection of said intermediate voltage level whereby said hands are moved to said reference positions; and manually operable means for temporarily overriding the output signal produced by said intermediate level detection means so that said gating means is unblocked and said hands are driven to display time represented by said time data output signals.

12. A watch as claimed in claim 11 wherein, said power source is a rechargeable power source.

* * * * *